US010695941B2

(12) United States Patent
Reiter et al.

(10) Patent No.: US 10,695,941 B2
(45) Date of Patent: Jun. 30, 2020

(54) DEVICE AND METHOD FOR FITTING AN EDGE PROFILE AND FURNITURE COMPONENT

(71) Applicant: Fritz EGGER GmbH & Co. OG, St. Johann in Tirol (AT)

(72) Inventors: Bruno Reiter, St. Johann in Tirol (AT); Stefan Steinacher, Fieberbrunn (AT)

(73) Assignee: Fritz Egger GmbH & Co. OG, St. Johann in Tirol (AT)

( * ) Notice: Subject to any disclaimer, the term of this patent is extended or adjusted under 35 U.S.C. 154(b) by 0 days.

(21) Appl. No.: 16/302,820

(22) PCT Filed: May 11, 2017

(86) PCT No.: PCT/EP2017/061372

§ 371 (c)(1),
(2) Date: Nov. 19, 2018

(87) PCT Pub. No.: WO2017/198551

PCT Pub. Date: Nov. 23, 2017

(65) Prior Publication Data

US 2019/0176360 A1 Jun. 13, 2019

(30) Foreign Application Priority Data

May 20, 2016 (DE) ..... 10 2016 109 362

(51) Int. Cl.
*B27D 5/00* (2006.01)

(52) U.S. Cl.
CPC ..... *B27D 5/003* (2013.01)

(58) Field of Classification Search
CPC ..... B27D 5/003; B29C 53/38; B29C 63/0026; B29C 63/003; B29C 66/86535; B32B 41/00; B32B 2041/04
See application file for complete search history.

(56) References Cited

U.S. PATENT DOCUMENTS 6,263,938 B1 * 7/2001 Maioli ..... B27D 5/003 156/351
2010/0269971 A1 10/2010 Schmid et al.
(Continued)

FOREIGN PATENT DOCUMENTS

DE 2433091 A 1/1976
DE 4025596 A1 2/1992
(Continued)

*Primary Examiner* — George R Koch
(74) *Attorney, Agent, or Firm* — The Web Law Firm

(57) ABSTRACT

The invention relates to an apparatus for fitting an edge profile on a narrow surface of a panel-form material in an edge-banding apparatus, having a panel carrier for accommodating a panel-form material. The panel carrier has an upper side running in a plane, having an edge-profile-feeding device, and having an edge-profile guide, said guide having at least one guide means along which or through which can be guided the edge profile. This can be fed by the edge-profile-feeding device. In order to prevent or reduce offsetting in the corner region of the panel-form material, the invention proposes that the at least one guide means should be movable relative to the panel carrier in a direction running at an angle to the plane in which the upper side of the panel carrier runs. The invention also relates to a method for fitting an edge profile, and to a furniture part produced thereby.

5 Claims, 2 Drawing Sheets

(56) References Cited

U.S. PATENT DOCUMENTS

| | | | | |
|---|---|---|---|---|
| 2013/0318697 | A1* | 12/2013 | Compton, Jr. ..... | E03D 11/16<br>4/252.4 |
| 2017/0129164 | A1 | 5/2017 | Rambacher et al. | |

FOREIGN PATENT DOCUMENTS

| | | | |
|---|---|---|---|
| DE | 4344997 | A1 | 7/1995 |
| DE | 202005015288 | U1 | 3/2007 |
| DE | 10123523 | B4 | 7/2008 |
| DE | 102007022078 | B4 | 4/2009 |
| DE | 202009019008 | U1 | 7/2015 |
| DE | 202015105931 | U1 | 12/2015 |
| RU | 2229375 | C2 | 5/2004 |
| SU | 1381151 | A1 | 3/1988 |
| SU | 1404345 | A1 | 6/1988 |
| WO | 2015140063 | A1 | 9/2015 |

* cited by examiner

DEVICE AND METHOD FOR FITTING AN EDGE PROFILE AND FURNITURE COMPONENT

CROSS-REFERENCE TO RELATED APPLICATIONS

This application is the United States national phase of International Application No. PCT/EP2017/061372 filed May 11, 2017, and claims priority to German Patent Application No. 10 2016 109 362.9 filed May 20, 2016, the disclosures of which are hereby incorporated in their entirety by reference.

BACKGROUND OF THE INVENTION

The present invention relates to a device for fitting an edge profile to a narrow face of a plate-like material, in particular an edge gluing device, having a plate carrier for receiving a plate-like material, wherein the plate carrier has a plate carrier upper side which extends in a plane, having an edge profile supply device for supplying an edge profile and having an edge profile guide for guiding the edge profile which has at least one guide means on which or by which the edge profile which can be supplied by the edge profile supply device can be guided along.

The invention further relates to a method for fitting an edge profile to a narrow face of a plate-like material, in particular using a device as defined above, in which a plate-like material is provided which has at least one narrow face and an upper side and a lower side, in which an edge profile is supplied to the narrow face and is applied thereto, and in which the edge profile is guided in an edge profile guide which has at least one guide means, on which or by which the supplied edge profile can be guided along, before and/or while it is being brought into contact with the narrow face.

Finally, the invention relates to a furniture component having a plate-like material which has at least one narrow face and an upper side and a lower side, and having at least one edge profile which is applied to a narrow face of the plate-like material.

FIELD OF THE INVENTION

The narrow faces of furniture components, for example, shelves, table plates or the like, which comprise wooden materials are mainly covered by edge profiles, which are also referred to as edge strips. The edge profiles (which) comprise a one-layer laminate or a multi-layer laminate (layer material) or an extruded plastics material. Edge profiles of this type are often provided with a decoration which is provided in the case of laminate or layer material edges, for example, by a printed decorative paper which is integrated in the layer structure, or in the case of extruded profiles, for example, by direct printing of the plastics profile.

There are known edge profiles which are greatly raised over the entire length thereof in a portion which adjoins the upper edge thereof with respect to the remaining surface of the edge profile in a dark manner. Therefore, the decoration comprises in this case, for example, a strip which is emphasised in terms of colour and which extends over the entire length of the edge profile and which has a uniform width. The strip or the upper and/or lower delimitation line which delimits the strip-like portion with respect to the remaining edge profile surface is further also known as a marking. Such a decoration having an offset strip is used to constitute a layer structure in a furniture component. In principle, it is also conceivable to provide an edge profile having a plurality of parallel strips or markings which extend in a longitudinal direction, which constitutes a layer structure of a large number of layers. In order to better impart the impression of a layer structure, it is important to fit the edge profile as parallel to the surface of the furniture component as possible.

This is difficult in known edge gluing machines because in this case the edge profiles are not guided adequately, particularly towards the end of the narrow face, that is to say, towards the furniture plate corner. However, this is particularly disadvantageous in the corner region of a furniture component because here differently positioned edges result in an offset of the decoration or markings in the direction perpendicular to the plate surface which can clearly be seen by the observer.

DESCRIPTION OF RELATED ART

In order to prevent such an offset, it is known from DE 20 2005 015 288 U1 to provide at the narrow face of the plate-like material a profile which extends over the entire length of the narrow face and which corresponds to a corresponding profile at the inner side of the edge profile. In this manner, the position of the edge profile relative to the surface of the plate is always the same. However, a problem is that the profiling of the narrow face is relatively complex. Also only edge profiles which have been adapted to this special profile can be used. Furthermore, any varying extent (varying spacing relative to the upper edge of the edge profile) of the decoration or marking on the edge profile cannot be taken into consideration, which can consequently result in an offset in the corner region again.

SUMMARY OF THE INVENTION

On this basis, an object of the present invention is to provide a device and a method for fitting an edge profile to a narrow face of a plate-like material, whereby a possible offset in the corner region of the plate-like material is prevented to the greatest possible extent or at least substantially reduced.

The object derived above and set out is achieved according to a first aspect of teaching of the present invention in a device for fitting an edge profile (edge strip) to a narrow face (edge face) of a plate-like material, in particular an edge gluing device,

- having a plate carrier for receiving a plate-like material, in particular a wooden material plate or a lightweight building board, wherein the plate carrier has a plate carrier upper side which extends in a plane,
- having an edge profile supply device for supplying an edge profile, in particular an extruded plastics profile or a laminate or layer material, and
- having an edge profile guide for guiding the edge profile which has at least one guide means on which or by which the edge profile which can be supplied by the edge profile supply device can be guided along, in that the at least one guide means can be moved relative to the plate carrier in a direction which extends at an angle relative to the plane in which the plate carrier upper side extends.

The movability of the guide means allows the edge profile to be optimally orientated relative to the upper side of the plate-like material or relative to the plane in which this upper side extends while it is supplied to the narrow face of the plate-like material. By the position of the guide means being adjusted, the position of the edge profile relative to the narrow face is also adjusted.

In a particularly preferable manner, a marking provided on the edge profile in accordance with the length or the extent of such a marking is compared with an upper side or the extent of an upper side of the plate-like carrier or the upper or lower side of a plate-like material which is positioned on the plate carrier and the position of the at least one guide means is adapted in the event of deviations of the vertical spacing between the marking and the plane in which the corresponding upper side or lower side extends. In this manner, particularly when the comparison between the marking and the upper side or lower side is carried out repeatedly or even continuously, it is ensured that the vertical spacing between the marking and the upper side of the plate-like material is always the same over the length of the narrow face or over the length of the edge profile. If two edge profiles then meet in a corner of the plate-like material, a vertical offset between the marking of one edge profile and the corresponding marking of the other edge profile can be prevented or at least substantially reduced.

The term "vertical" is used for the sake of simplicity to indicate the direction in which the spacing between the upper edge of the plate-like material and the lower edge of the plate-like material is shortest. In this case, the upper edge connects the upper side of the plate-like material to the narrow side thereof, the lower edge connects the lower side to the narrow side mentioned. In other words, the vertical direction is the direction in which the thickness dimension of the plate-like material extends.

The term "marking" which is provided on the edge profile is intended to refer to a strip-like portion of a decoration which extends over the length of the edge profile and which is offset (emphasised) with respect to the remaining decoration as a whole optically and/or haptically, that is to say, forms a continuous strip which is offset optically and/or haptically, or regions which are offset (emphasised) optically and/or haptically with respect to the remaining decoration are arranged over the length of the edge profile. The strip which is offset optically and/or haptically or the regions which are offset optically and/or haptically may be in one colour or multiple colours and/or patterned.

The strip-like portion is delimited at the two sides by a notional delimitation line, in particular by a notional straight line, which the optically and/or haptically offset regions touch but do not exceed. For example, an undulating strip could be printed on the edge profile, wherein one of the notional straight lines then touches the wave peaks and the other of the notional straight lines then touches the wave troughs at the outer side. The term "extent" of the marking is intended to refer to the extent of the notional delimitation lines or straight lines.

As a result of the method according to the invention, it is ensured to a particular extent that two markings or delimitation lines of edge profiles which meet each other in a plate corner do not have any vertical offset or only a very small vertical offset relative to each other.

Different embodiments of the device according to the invention, to which the dependent claims also relate, will now be described below.

Thus, according to one embodiment of the device according to the invention there is provision for the edge profile guide to have as guide means an upper guide portion and a lower guide portion, respectively, between which the edge profile which can be supplied by the edge profile supply device can be guided along, wherein the upper guide portion and the lower guide portion can be moved relative to the plate carrier in a direction which extends at an angle to the plane in which the plate carrier upper side extends. The edge profile is guided both at the upper side and at the lower side by an upper guide portion and a lower guide portion while it is transported by the edge profile supply device in the direction of the narrow face, whereby the positioning of the edge profile is optimised relative to the narrow face or relative to the extent of the upper side of the plate-like material.

According to yet another embodiment of the device according to the invention, there is provision for the upper guide portion to be able to be moved relative to the lower guide portion in a direction which extends at an angle to the plane in which the plate carrier upper side extends. The upper guide portion and the lower guide portion are therefore movable independently of each other, whereby the vertical spacing between the upper guide portion and the lower guide portion varies and can thereby be adapted to different edge profile widths. In this case, there is further provision for the unit comprising the upper guide portion and the lower guide portion to be able to be moved as a whole back and forth in order to allow an orientation relative to the upper side of the plate-like material and/or relative to the upper side of the plate carrier.

Again according to another embodiment of the device according to the invention, there is provision for the direction in which the respective guide means can be moved to extend perpendicularly to the plate carrier upper side. This readily allows an orientation of the edge profile relative to a narrow face which also extends perpendicularly to the plate carrier upper side. This is the usual case in a plate-like material which has a cuboid form, in which the narrow face extends at right-angles to the plane in which the upper side extends and the plane in which the lower side extends. Where necessary, however, it is also conceivable for the respective guide means to be moved at a different angle relative to the plate carrier upper side if, for example, the narrow face of the plate-like material does not extend at right-angles but instead at a different angle relative to the upper side and lower side of the plate-like material.

According to yet another embodiment of the device according to the invention, there is provision for the device to have a control device which controls the position of each guide means, in particular the upper guide portion and the lower guide portion. When it is said that the position of the respective guide means is controlled, it is intended to be understood that the position relative to the plane, in which the plate carrier upper side or the upper and/or lower side of the plate-like material extends, is adjusted (controlled). Therefore, the control device effects movements of the respective guide means relative to the plate carrier and consequently relative to the narrow face of a plate-like material positioned thereon in the direction mentioned which extends at an angle relative to the respective plane mentioned. In particular, the movements extend or the change of the position of the respective guide means is takes place parallel to the narrow face in the direction of the width of the narrow face.

According to yet another embodiment of the device according to the invention, there is provision for the device to have at least one sensor, in particular at least one optical sensor, which is connected to the control device, wherein a data connection therefore exists between the sensor and the control device. This may be provided in a wireless or wired state. A sensor can detect the position of the edge profile or a marking on the edge profile during the supply of the edge profile relative to the narrow face. The extent of the upper side of the plate-like material and/or the upper delimitation edge of the narrow face can also be detected with a sensor, in particular with an additional sensor.

According to yet another embodiment of the device according to the invention, there is provision for the control device to be constructed in such a manner that it controls the position of each guide means in accordance with sensor data transmitted by the respective sensor, in particular controls it in such a manner that the extent of a marking provided over the length of the edge profile is orientated parallel to the plane in which the plate carrier upper side extends or parallel to the plane in which the upper side of the plate-like material extends. If two edge profiles which meet each other at a corner of the plate-like material are now fitted to a plate-like material, each of the two edge profiles can be positioned by the edge profile guide provided according to the invention and the control device in such a manner that the marking of one edge profile meets the marking of the other edge profile relatively precisely in the corner of the plate-like material. A vertical offset between the markings can thereby be prevented or at least substantially reduced.

According to yet another embodiment of the device according to the invention, there is provision for the control device to be constructed in such a manner that it controls the position of the respective guide means automatically and in particular continuously or at regular intervals. Therefore, the control device repeatedly compares, in particular continuously or at regular intervals, the position of the respective guide means and in particular the position of the marking, on the one hand, with the position of the plate carrier upper side or the upper and/or lower side of the plate-like material, on the other hand.

In particular, the control device ensures a precise predetermined extent of a marking on the guide means. By the control device taking into consideration the marking or the extent of the marking during the control and comparing it with the upper side or the extent of the upper side of the plate-like material, it is also ensured that the marking always extends with a predetermined spacing from the plate surface, in particular parallel therewith, independently of the extent of the marking on the edge profile. Thus, it is also conceivable for the marking not to extend exactly parallel to the upper edge of the edge profile as a result of production tolerances or production defects on the edge profile. In the latter case, however, this is negligible because the control device does not use the upper edge of the edge profile but instead the marking itself in order to adjust the edge profile guide.

The object is further achieved according to a second aspect of teaching of the present invention in a method for fitting an edge profile to a narrow face of a plate-like material, in particular using a device as defined above,

- in which plate-like material is provided which has at least one narrow face and an upper side and a lower side (this is intended to be understood to be the main sides with the largest surface, wherein the narrow face connects the upper side to the lower side),
- in which an edge profile is supplied to the narrow face and is applied thereto, and
- in which the edge profile (prior to the edge profile being applied to the narrow face) is guided in an edge profile guide which has at least one guide means, on which or by which the edge profile which is supplied can be guided along before and/or while it is being brought into contact with the narrow face, that is to say, is joined together, in that the at least one guide means is moved relative to the upper side of the plate-like material in a direction which extends parallel to the plane in which the upper and lower edges of the narrow face extend.

In the case of a planar narrow face, the entire narrow face extends in the plane mentioned. If the narrow face is curved outwards or inwards, however, only the upper and the lower delimitation edges of the narrow face extend in the plane mentioned. In the case of a cuboid, plate-like material, this plane extends at right-angles to the upper side and lower side of the plate-like material.

According to an embodiment of the method according to the invention, there is provision for the edge profile guide to have as guide means an upper guide portion and a lower guide portion, between which the edge profile supplied by the edge profile supply device is guided along, wherein the upper guide portion and the lower guide portion are moved relative to the upper side of the plate-like material in a direction which extends parallel to the plane in which the upper and lower edges of the narrow face extend.

According to yet another embodiment of the method according to the invention, there is provision for the upper guide portion to be moved relative to the lower guide portion in a direction which extends parallel to the plane in which the upper and lower edges of the narrow face extend.

Again according to another embodiment of the method according to the invention, there is provision for the position of each guide means, in particular the upper guide portion and the lower guide portion, to be controlled.

According to another embodiment of the method according to the invention, there is provision for the position of each guide means to be controlled in accordance with sensor data which are transmitted by a sensor.

According to yet another embodiment of the method according to the invention, there is provision for the position of each guide means to be controlled in such a manner that the extent of a marking which is provided over the length of the edge profile is orientated parallel to the plane in which the upper side of the plate-like material extends.

According to yet another embodiment of the method according to the invention, there is provision for the marking to be an optical and/or haptic marking and in particular to be a portion of a decoration, wherein the marking is preferably at least one line which extends over the length of the edge profile. The decoration may have been produced by printing and/or stamping. For example, it is conceivable to stamp a corresponding structure via a stamping roller into the surface of the edge profile. Additionally or alternatively, edge profiles can also be printed with colours, for example, by means of digital printing or rotogravure. The entire visible surface of the edge profile then forms the so-called decoration. A portion of the decoration is the marking, which has already been mentioned several times and relative to which the control device or the sensor system which communicates with the control device is orientated. In the simplest case, the marking is a strip which extends over the length of the edge profile and which is emphasised with respect to the remainder of the visible side of the edge profile optically (with colours) and/or haptically (perceptibly).

Again according to another embodiment of the method according to the invention, there is provision for the position of the respective guide means to be controlled automatically and in particular continuously or at regular intervals.

According to yet another embodiment of the method according to the invention, there is provision for the width of the edge profile to be adapted to the width of the narrow side of the plate-like material after the application. Thus, it is conceivable for the width of the edge profile to be greater, before the application to the narrow face, than the width of the narrow face, whereby a potentially non-uniform extent of the upper and/or lower edge of the edge profile relative to the extent of the marking on the edge profile can be compensated for. Thus, as already mentioned above, it is conceivable for production reasons for the edges of the edge profile not to always extend exactly parallel to the marking. In this case, as a result of the device according to the invention and the method according to the invention, the marking is orientated relative to the narrow face of the plate-like material independently of the edge extent of the edge profile and any protrusions of the edge profile can be removed, for example, cut off or ground off.

Finally, the object is achieved according to a third aspect of teaching of the present invention in a furniture component having a plate-like material which has at least one narrow face and an upper side and a lower side, and having at least one edge profile which is applied to a narrow face of the plate-like material, in that the furniture component is produced by a method as defined above.

The plate-like material is, as already mentioned, in particular a wooden material plate, for example, a particle board, fibre board or OSB board. The plate-like material may also be a lightweight construction board which in particular has covering layers of a wooden material and a central layer of a honeycomb structure, in particular honeycomb cardboard structure. The plate-like material may have also been provided with a coating before or after the edge profile is applied. The furniture component mentioned is in particular a table plate, a working plate, for example, kitchen work surface, a shelf, a lateral portion of a shelving unit or the like.

According to an embodiment of the furniture component according to the invention, there is provision for the plate-like material to have two narrow faces which meet in a corner of the plate-like material, in particular at right-angles, wherein an edge profile is applied to both narrow faces, respectively, and the ends of the edge profiles meet each other at the corner. In this context, the edge which is referred to as the corner is the one at which the two narrow faces meet each other and which extends from the upper side to the lower side of the plate-like material. An edge profile, as described above, is applied to each of the two narrow faces mentioned. Preferably, both edge profiles are applied to the respective narrow face by the method according to the invention and/or using the device according to the invention.

According to yet another embodiment of the furniture according to the invention, there is provision for the two edge profiles each to have a marking which is identical at least in a portion adjoining the respective end of the edge profile or completely, wherein an offset in the direction which extends perpendicularly to the plane in which the upper and lower edges of the narrow face extend between the marking at the end of one edge profile and the marking at the end of the other edge profile is a maximum of 0.5 mm, preferably a maximum of 0.35 mm, particularly preferably a maximum of 0.2 mm. This is particularly the case at all the corners of a plate-like material in which two edge profiles with a marking meet each other. In particular, it is ensured by the device according to the invention and/or the method according to the invention that the offset is also within the above-mentioned limits in the case of a plurality of furniture components which are provided with an edge profile directly one after the other by means of the device according to the invention and/or by means of the method according to the invention.

The invention also relates accordingly to a furniture component, in particular a furniture component as described above, having a plate-like material which has at least two narrow faces and an upper side and a lower side, and having at least two edge profiles which are applied to a narrow face of the plate-like material, wherein two of the edge profiles each have a marking which is identical at least in a portion adjoining the respective end of the edge profile or completely, wherein an offset in the direction which extends perpendicularly to the plane in which the upper edge and lower edge of the narrow face extend between the marking at the end of one edge profile and the marking at the end of the other edge profile is a maximum of 0.5 mm, preferably a maximum of 0.35 mm, particularly preferably a maximum of 0.2 mm.

BRIEF DESCRIPTION OF THE DRAWINGS

There are now a large number of possibilities of configuring and developing the device according to the invention, the method according to the invention and the furniture component according to the invention. In this regard, reference may be made, on the one hand, to the claims following claims 1, 9 and 18 and, on the other hand, to the description of embodiments in conjunction with the drawings, in which:

DESCRIPTION OF THE INVENTION

Figure 1:
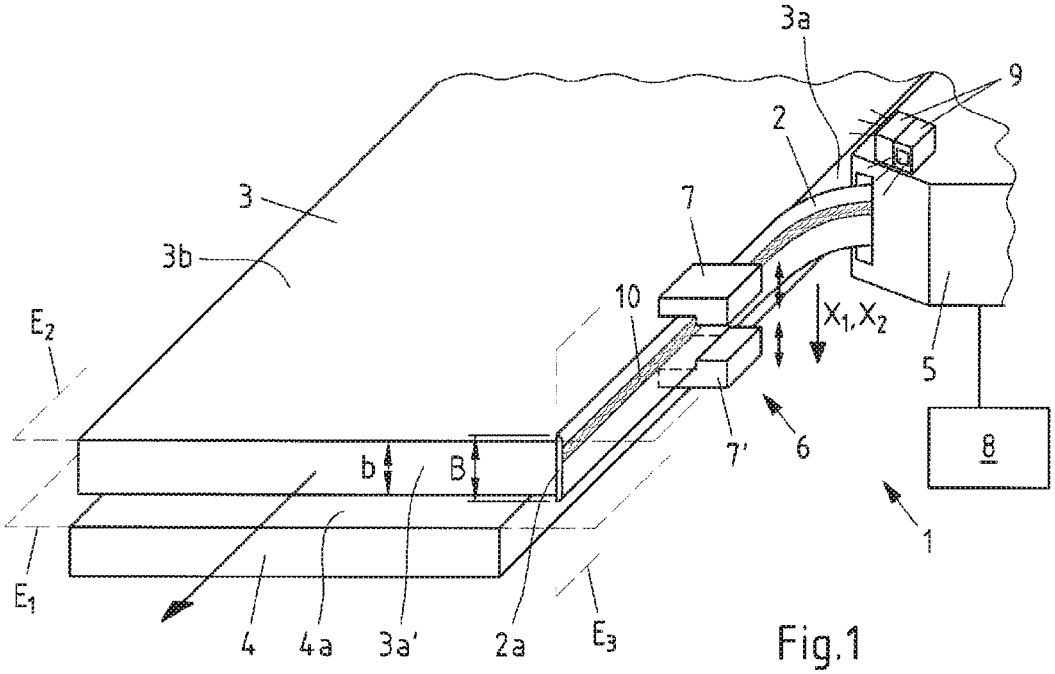
FIG. 1 is a schematic illustration of an embodiment of the method according to the invention using the device according to the invention.

FIG. 1 is a schematic view of the basic structure of a device 1 according to the invention for fitting an edge profile 2 or 2' to a narrow face 3*a* or 3*a'* of a plate-like material 3, here by way of example a wooden material plate 3.

The device 1 has a plate carrier 4 for receiving the wooden material plate 3. The plate carrier 4 may be a portion of a fixed frame or a portion of a transport device, for example, a transport belt. In the latter case, the wooden material plate 3 is guided past the devices which are used for fitting the edge profile, particularly at a uniform speed, wherein the mentioned devices, that is to say, an edge profile supply device 5 and an edge profile guide 6, are fixed in position. The plate carrier 4, for example, the conveyor belt, has a plate carrier upper side 4*a* which extends in a plane $E_1$.

The edge profile supply device 5 is used for supplying an edge profile 2 or 2', in this case, for example, a previously separately extruded edge profile 2 or 2' which is provided with a marking 10 or 10'. The edge profile supply device 5 is only schematically illustrated here.

This may have different elements, for example, rollers, cylinders or the like, for the transport of the respective edge profile 2 or 2'.

In a state downstream of the edge profile supply device 5 is the edge profile guide 6 which orientates the edge profile 2 or 2' relative to the wooden material plate 3 and which presses with elements not illustrated here, such as rollers, cylinders or the like, against the narrow face 3*a* or 3*a'*.

The edge profile guide 6 has as guide means 7 or 7' an upper guide portion 7 and a lower guide portion 7', between which the edge profile 2 or 2' which is supplied by the edge profile supply device 5 is guided along. The upper guide portion 7 and the lower guide portion 7' are both movable relative to the plate carrier 4 and consequently also relative to the wooden material plate 3 in a direction $X_1$ which extends at right-angles to the plane $E_1$ in this case.

Both the unit comprising the upper guide portion 7 and the lower guide portion 7' as a whole and the upper guide portion 7 and/or the lower guide portion 7' alone are movable back and forth in the direction $X_1$. As a result, on the one hand, the spacing between the upper guide portion 7 and the lower guide portion 7' can be adapted to different widths B of an edge profile 2 or 2'. On the other hand, the position of the respective edge profile 2 or 2' relative to the extent of the plane $E_1$ can be adapted in such a manner that the marking 10 or 10' on the edge profile 2 or 2' always extends with a defined spacing from the plane $E_1$ when the edge profile 2 or 2' is applied.

The movements of the upper guide portion 7 and the lower guide portion 7' or the positions thereof are controlled by a control device 8 which is connected in the present embodiment to two optical sensors 9. One of the sensors 9 detects the extent of the upper side 3*b* of the wooden material plate 3 and consequently the extent of the plane $E_2$. The other of the sensors 9 detects the extent of the marking 10 or 10' provided on the edge profile 2 or 2', respectively.

The control device 8 thereby allows the movements or positions of the upper guide portion 7 and the lower guide portion 7' to be controlled in accordance with the sensor data so that the marking 10 or 10' which extends over the length L of the edge profile 2 or 2' is orientated parallel to the plane $E_1$ in which the plate carrier upper side 4*a* extends and parallel to the plane $E_2$ in which the upper side 3*b* of the wooden material plate 3 extends.

Figure 3:
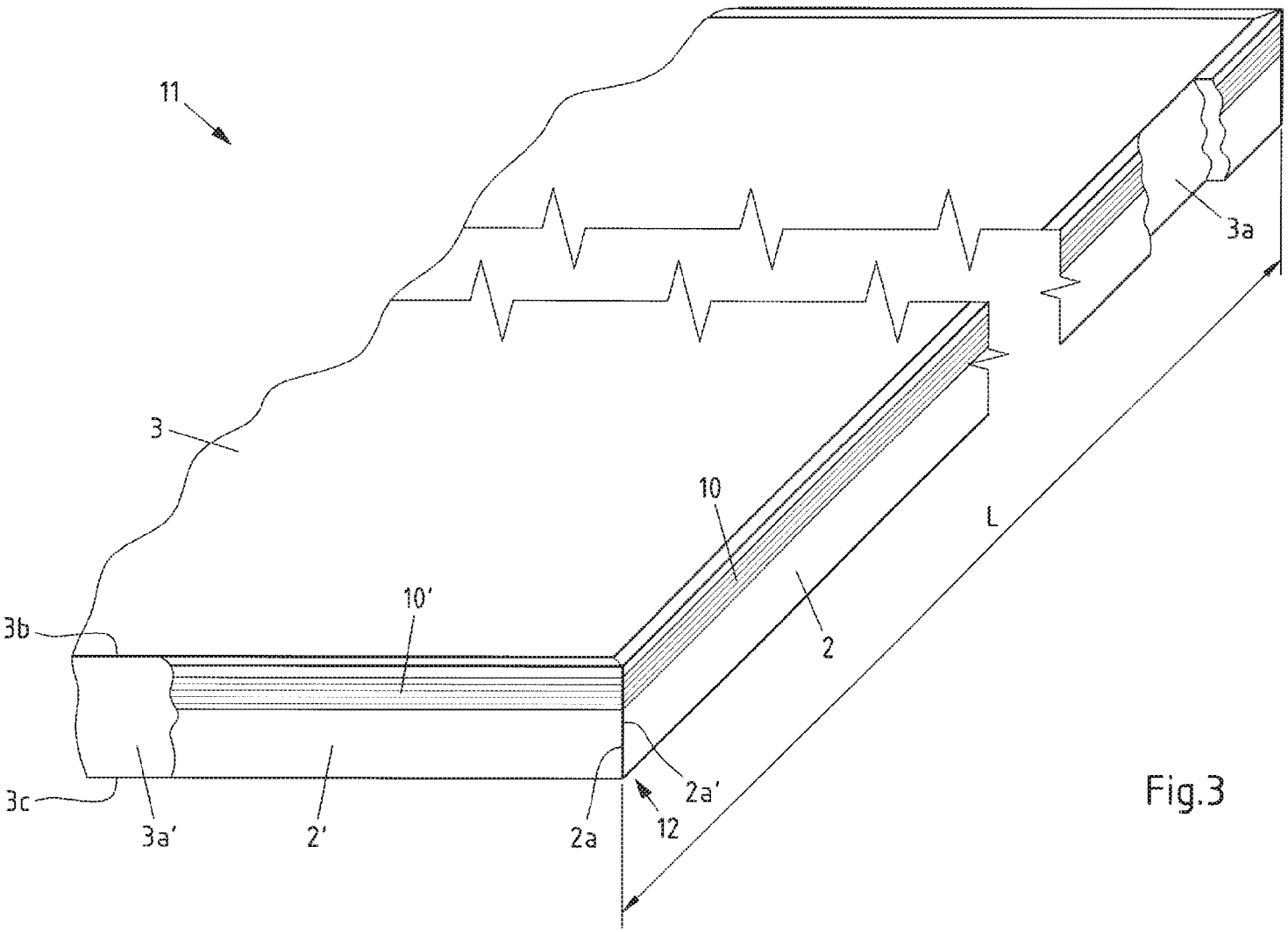
FIG. 3 shows a furniture component produced by the method according to the invention and/or the device according to the invention.

The device 1 according to the invention ensures, as FIG. 3 shows, that on the furniture component 11 two edge profiles 2 and 2' which each have an identical marking 10 or 10' are fitted to the respective narrow face 3*a* or 3*a'* so that a vertical offset in a direction $X_2$ which extends parallel to the plane $E_3$ of the narrow face 3*a* or 3*a'* in a corner 12 of the wooden material plate 3 between the marking 10 at the end 2*a* of one edge profile 2 and the marking 10' at the end 2'*a* of the other edge profile 2' is at a maximum 0.5 mm.

In the method according to the invention in which the positions or movements of the respective guide means 7 or 7' are controlled automatically and continuously, there may also be provision for the respective edge profile 2 or 2' to have a greater width B before being supplied to the respective narrow face 3*a* or 3*a'* than the width b of the respective narrow side 3*a* or 3*a'*. Since the orientation of the edge profile 2 or 2' relative to the narrow face 3*a* or 3*a'* according to the invention is carried out in particular only taking into consideration the extent of the respective marking 10 or 10', it may be the case that the outer edges of the edge profile 2 or 2', when the edge profile 2 or 2' is adhesively bonded to the respective narrow face 3*a* or 3*a'*, protrude by different distances with respect to the side 3*b* or lower side 3*c* of the wooden material plate 3. In this case, the protruding edge regions of the adhesively bonded edge profile 2 or 2' are then removed, whereby the width B of the edge profile 2 or 2' can be adapted to the width b of the narrow side 3*a* or 3*a'*. FIG. 1 shows by way of example the case that the width B of the edge profile 2 or 2' is greater than the width b of the associated narrow side 3*a* or 3*a'*. The following step of removing a portion of the respective edge profile 2 or 2' is not illustrated here.

Figure 2:
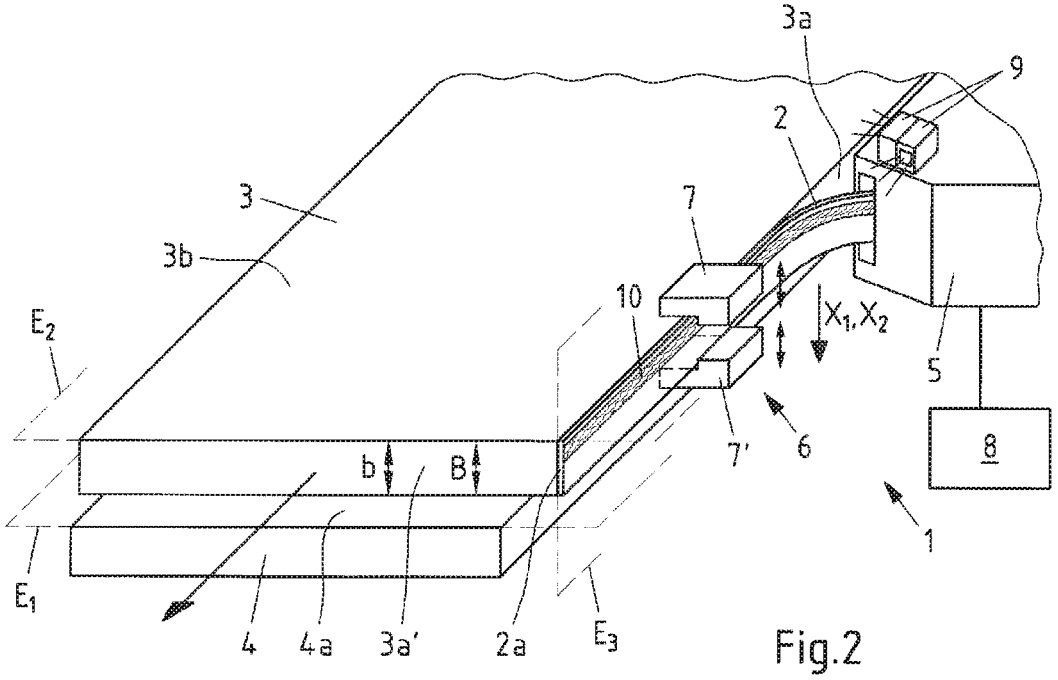
FIG. 2 is a schematic illustration of another embodiment of the method according to the invention using the device according to the invention.

FIG. 2 shows, in comparison with FIG. 1, the similarly conceivable case that the edge profile 2 or 2' has the same width from the start as the width b of the narrow side 3*a* or 3*a'*. In this case, an additional step of removal does not have to be carried out after the adhesive bonding of the edge profile 2 or 2' to the respective narrow face 3*a* or 3*a'*.

The invention claimed is:

1. A method for fitting an edge profile to a narrow face of a plate-like material, the method comprising:

providing a device for fitting the edge profile to the plate-like material, the device comprising:

a plate carrier for receiving the plate-like material, wherein the plate carrier has a plate carrier upper side which extends in a plane;

an edge profile supply device configured to supply the edge profile; and an edge profile guide configured to guide the edge profile, the edge profile guide having an upper guide portion and lower guide portion, respectively, between which the edge profile can be guided along, wherein the upper guide portion and the lower guide portion can be moved relative to the plate carrier in a direction which extends at an angle to the plane in which the plate carrier upper side extends;

providing the plate-like material having at least one narrow face, an upper side, and a lower side, supplying the edge profile to the at least one narrow face with the edge profile supply device;

applying the edge profile to the at least one narrow face; and guiding the edge profile in the edge profile guide on which or by which the edge profile can be guided along before and/or while it is being brought into contact with the at least one narrow face, wherein the upper guide portion and the lower guide portion of the edge profile guide are moved relative to the upper side of the plate-like material in a direction which extends parallel to a plane in which upper and lower edges of the at least one narrow face extend, and wherein the step of guiding the edge profile in the edge profile guide comprises: controlling a position of the upper guide portion and the lower guide portion relative to the upper side of the plate-like material in accordance with sensor data transmitted by a sensor in such a manner that an extent of a marking which is provided over a length of the edge profile is orientated parallel to a plane in which the upper side of the plate-like material extends.

2. The method according to claim 1, wherein the upper guide portion moves relative to the lower guide portion in a direction which extends parallel to the plane in which the upper and lower edges of the at least one narrow face extend.

3. The method according to claim 1, wherein the marking is an optical and/or haptic marking and is a portion of a decoration.

4. The method according to claim 1, wherein the position of the upper guide portion and the lower guide portion is controlled automatically.

5. The method according to claim 1, wherein a width of the edge profile is adapted to a width of the at least one narrow face of the plate-like material after the step of applying the edge profile to the at least one narrow face.

* * * * *